US005483948A

United States Patent [19]

van der Veen

[11] Patent Number: 5,483,948

[45] Date of Patent: Jan. 16, 1996

[54] COMPACT GAS-FIRED INFRARED RADIATOR OF CLOSED DESIGN

[75] Inventor: Geuko van der Veen, Deventer, Netherlands

[73] Assignee: Gastec N.V., Apeldoorn, Netherlands

[21] Appl. No.: 304,302

[22] Filed: Sep. 12, 1994

[30] Foreign Application Priority Data

Sep. 13, 1993 [NL] Netherlands ..... 9301581

[51] Int. Cl.[6] ..... F24C 3/00

[52] U.S. Cl. ..... 126/91 R; 126/91 A; 126/92 AC; 126/92 C; 431/347; 431/326

[58] Field of Search ..... 126/91 R, 91 A, 126/92 AC, 92 C; 431/347, 326

[56] References Cited

U.S. PATENT DOCUMENTS 3,395,693 8/1968 Cowan ..... 126/92

FOREIGN PATENT DOCUMENTS 0486741 5/1992 European Pat. Off. .
2624253 6/1989 France .
2680225 2/1993 France .

*Primary Examiner*—Larry Jones
*Attorney, Agent, or Firm*—Weingarten, Schurgin, Gagnebin & Hayes

[57] ABSTRACT

A gas-fired infrared radiator comprising a closed housing which includes a combustion chamber, with a side of the radiator that is to be directed towards an object being a radiation plate which forms a boundary of the combustion chamber, and comprising at least one burner, wherein the or each burner is a high-speed burner adapted for combustion in two combustion stages, with the second combustion stage taking place in the combustion chamber, the or each high-speed burner is arranged in such a manner that a flame formed by the or each high-speed burner is directed at the radiation plate, and gas guiding means are provided for partly recirculating flue gas which has been passed along the radiation plate, to the first or second combustion stage.

13 Claims, 1 Drawing Sheet

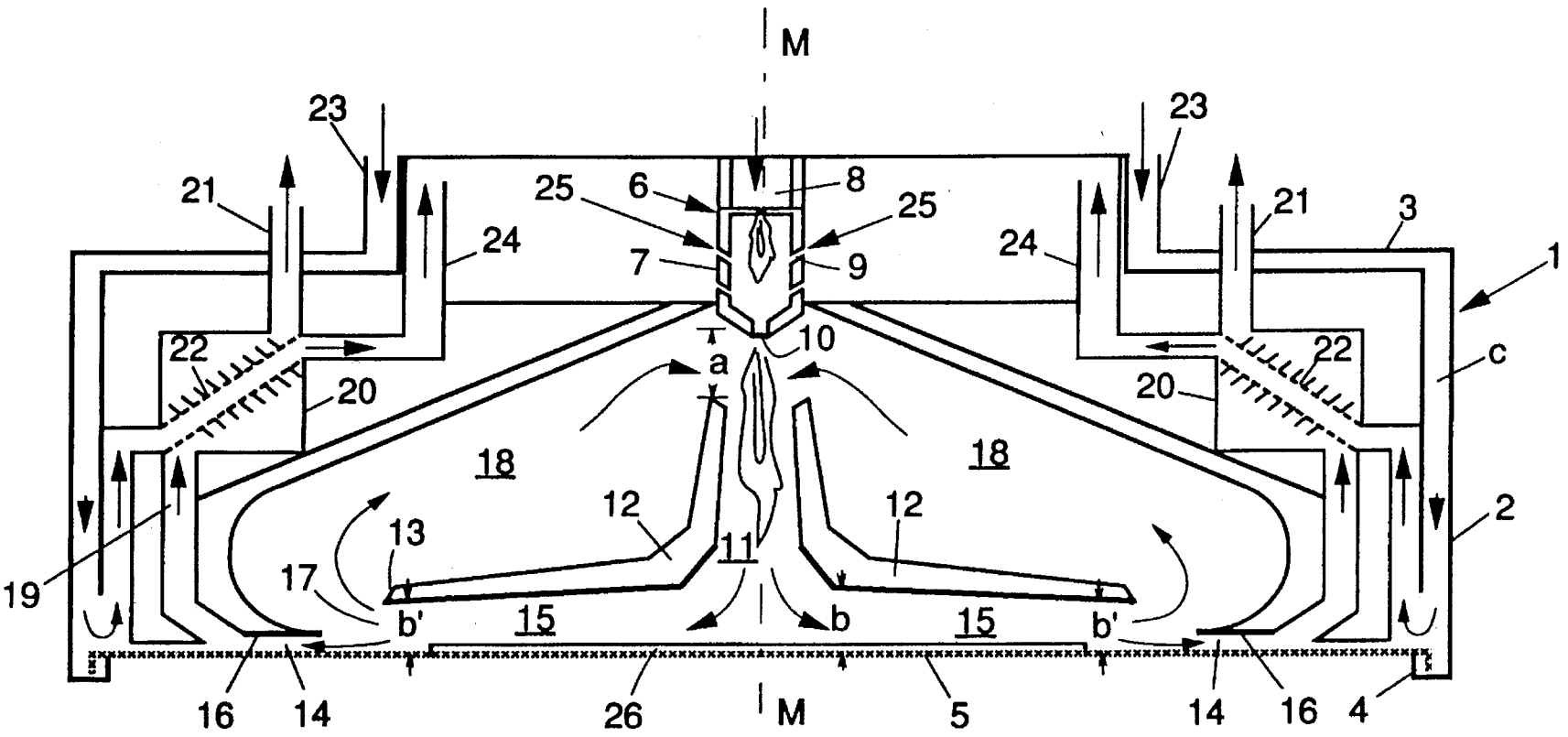
1
c
2
3
4
21
22
16
14
23
20
b'
24
18
15
5
25
12
8
9
10
b
M
M
11
a
6
7
26
13
17
19

COMPACT GAS-FIRED INFRARED RADIATOR OF CLOSED DESIGN

BACKGROUND OF THE INVENTION

This invention relates to a gas-fired infrared radiator as set forth in the preamble of claim 1.

Such an infrared radiator is disclosed in FR-A-2 680 225, for the purpose of space heating.

DESCRIPTION OF THE PRIOR

A disadvantage of the prior art device is that its capacity is very limited, which is partly a consequence of the type of burner which is used in this known infrared radiator. The prior art publication involves a normal burner with a relatively low flame intensity. As a consequence, the temperature of the radiation plate is in the range of 380° C. to 450° C. As a result of this relatively low temperature, the radiation capacity at room temperature will be about 10 kW per square meter of radiation plate. When used in an environment with higher temperatures, which is typically the case in industrial drying and heating processes, an infrared radiator with such a low radiation plate temperature cannot be used. Another drawback of the prior art gas-fired infrared radiator is that no measures have been taken to lower the $NO_x$ content. In addition, the prior art gas-fired radiator has relatively large dimensions and the temperature distribution over the plate is not uniform.

Therefore, in a number of industrial drying and heating processes, heretofore use has been made of convection heat. The use of infrared radiation for these purposes would entail a saving of energy but, as set out hereinabove, the use thereof has been limited to date for lack of efficient gas-fired infrared radiators.

On the other hand, electrical radiators are employed for various uses, such as the drying of printing inks in the graphic industry and the drying of foods. This otherwise clean form of heat generation, however, has a moderate energetic efficiency. This is caused, on the one hand, by the low generation efficiency of about 42% in the production of electricity, and, on the other, by the radiation efficiency which varies between 50% with radiation panels and 80% with quartz tube radiators. Calculated on the primary energy, the radiation efficiency is therefore 20–30%. If the convective heat of these radiation sources is utilized as well, the overall efficiency may rise to 40%.

In gas-fired radiators of open design, the radiation efficiency, calculated on primary energy, is higher, viz. 40–50% and if the residual heat of the open radiator can also be used in the process in question, the overall heat utilization may run up to 80–90%.

In a number of processes, however, open gas-fired radiators have a number of disadvantages. Most important among them are the following:

- the flue gases can come into contact with the product, for instance foodstuffs;
- open radiators are susceptible to damage, sensitive to pollution and sometimes constitute fire hazards;
- the effect of combined use of infrared radiation and convection is limited by the influence of air movements on the operation of the burner;
- possible contamination of the product (for instance in the case of foodstuffs, film, etc.) due to erosion products of the radiator has to be reckoned with;

- with printing machines, extracted solvent vapors are mixed with flue gases, which is undesirable if the solvent is to be recovered; and
- the relatively large dimensions of gas-fired radiators limit the possibility of using them in replacement of electrical radiators.

SUMMARY OF THE INVENTION

Accordingly, the object of the present invention is to modify a compact gas-fired infrared radiator of the closed type as disclosed in FR-A-2 680 225 in such a manner that the above-described drawbacks thereof are overcome, thereby rendering it suitable for use in industrial heating and drying processes and the radiator according to the invention should at the same time contribute to the saving of energy and to the reduction of environmentally unacceptable emissions.

To realize these objects, the gas-fired infrared radiator is characterized, according to the invention, by the features of claim 1.

Because a high-speed burner is used, where the combustion occurs in two stages and whose flame is aimed at the radiation plate, the radiation plate acquires a temperature of about 1000° C., which leads to a radiation capacity of about 100 kW per square meter of radiation plate when the radiator is used in an environment of room temperature. Accordingly, the radiation capacity of the radiator of the invention is ten times as high as the capacity of the infrared radiator disclosed in FR-A-2 680 225.

Because a part of the flue gases, after being guided along the radiation plate and having cooled off as a result, is recirculated to the first or second combustion stage, the flame is cooled, which leads to an appreciable reduction of the $NO_x$ content in the flue gases. Recirculation to the first stage can be effected through external recirculation whereby flue gas which has passed the radiation plate is mixed with combustion air which is being fed to the first stage of the burner. Recirculation to the second combustion stage can be effected through internal flue gas recirculation in the combustion chamber, with the walls of the combustion chamber serving as gas guiding means and the flue gases recirculating under the pressure adjacent the second combustion stage which is created by the injector action of the high-speed burner.

Because the radiator is otherwise of the closed type, the resultant combustion products remain completely separated from the product to be treated and from the process space. Moreover, process vapors or dust cannot penetrate the combustion chamber. This renders the gas-fired radiator of the invention eminently suited for practically all applications where it is abolutely imperative that contamination of the product to be heated or dried is avoided, as in the food industry.

In order to effect optimum heating of the radiation plate, the infrared radiator is characterized, in accordance with a further elaboration of the invention, by the features of claim 2.

In further elaboration of the invention, the infrared radiator is characterized by the features of claim 3. Thus the thermal efficiency of the burner is increased.

In particular for industrial heating or dying processes where the radiator is, for instance, arranged above a conveyor of, for instance, a conveyor furnace, it is particularly advantageous, for the purpose of obtaining a uniform heating across the width of the conveyor, if the radiator includes the features as set forth in claim 4.

To effect a uniform high degree of heating of the radiation plate of the elongate box-shaped radiator, the radiator can, in further elaboration of the invention, be characterized by the features of claim 5.

The row of burners forces hot flue gases in the direction of the middle of the radiation plate and through the lateral flow passages. As a result, the radiation plate is directly heated convectively by the hot flue gases and indirectly heated by radiation from the combustion chamber walls and the guiding plates.

A further contribution to the uniform heating of the radiation plate is provided by the features of claims 6 and 7.

In further elaboration of the invention, the gas-fired infrared (IR) radiator is characterized by the features of claim 8.

Because of the injector action of the burners, a part of the flue gases is sucked back from the branch passages, passing behind the L-shaped guiding plates, to the inlet of the combustion chamber where the recirculated flue gas is mixed with the hot flue gases from the second combustion stage.

Because of the combustion of the gas in two stages and because of the cooling effect of the recirculated flue gas, the flame temperature is lowered and the $NO_x$ emission is limited. The gas stream in the combustion chamber, enlarged by the admixture of return gas, also contributes to the uniform heating of the radiation plate.

BRIEF DESCRIPTION OF THE DRAWING

To clarify the invention, an exemplary embodiment of the compact gas-fired infrared radiator of closed design will be described hereinafter with reference to the accompanying drawing.

DESCRIPTION OF THE PREFERRED EMBODIMENT

Referring to the drawing, which shows the burner in cross-section, the burner comprises a housing 1 with sidewalls 2 extending perpendicularly to the plane of the paper, for instance over a length of 1 meter, a rear wall 3 connecting thereto, whilst the open front side of the housing 1 is bounded by flanged U-shaped longitudinal edges 4 of the sidewalls 2. The housing 1 is of double-walled design with a cavity c.

The open front side of the housing 1 is closed off by a radiation plate 5 of refractory metal, of ceramic material or of quartz glass.

Arranged in the longitudinal center plane M—M of the housing 1 is a row of burners 6 which, in the embodiment shown, are designed as high-speed two-stage burners. The row of burners 6 have a common burner head 7 in which respective gas supply passages terminate and in which inflow openings 9 for combustion air are provided. The common burner head is closed off at the outlet side by a perforated thrust plate 10.

Between the burner head 7 and the radiation plate 5, a narrow combustion chamber 11 is defined by two L-shaped guiding plates 12 arranged symmetrically relative to the longitudinal center plane M—M.

The combustion chamber 11 begins at a distance (a) from the burner head 7, extends perpendicularly to the radiation plate 5 and terminates adjacent the radiation plate at a distance (b) therefrom, ending in flow passages 15 which extend on opposite sides of and away from the longitudinal center plane M—M of the housing 1 and which end in discharge gaps 14 adjacent the longitudinal side edges 13 of the guiding plates 12. The height of the flow passages 15 gradually decreases from b to b', with b>b'.

In the discharge gaps 14, branch passages 17 have been separated by means of baffles 16. Through the branch passages 17 spaces 18 located behind the L-shaped guiding plates 12 communicate with the inlet side of the combustion chamber 11, downstream of the thrust plate 10.

Connecting to the discharge gaps 14 of the flow passages 15 for flue gases are ducts 19 which communicate the flow passages 15 with heat exchangers 20 and discharge ducts 21 for flue gas.

In the heat exchangers 20 a passage 22 is indicated, which, in the embodiment shown, is formed by a finned pipe. At one end, the finned pipe 22 communicates via the cavity c in the double housing wall 2 with an inlet 23 for combustion air, which may be connected to the delivery side of a fan (not shown). At the other end, the finned pipe 22 communicates via a duct 24 with a space 25 from which combustion air can flow into the burner head 7 via the inflow openings 9.

The burner of the invention in the embodiment shown operates as follows.

The row of burners 6 are pressure-fed with gas via the gas supply 8 and with air via the inlet 23, the cavity c in the housing wall 2, the finned pipe 22 in the heat exchanger 20, the space 25 and the inflow openings 9 in the burner head 7. The first combustion stage takes place in the burner head 7. The mixture of completely and partially burnt gas forced through the thrust plate is blown into the combustion chamber 11 uniformly distributed over the length of the burner, whereby the radiation plate is directly heated convectively by the hot flue gases and indirectly heated by radiation from the walls of the combustion chamber and from those parts of the L-shaped guiding plates 12 extending substantially parallel to the radiation plate. The gudiing plates can be made of refractory metal, ceramic material or quartz glass and then function as secondary radiator. When a quartz glass plate 5 is used, a part of the radiation coming from the secondary radiator 12 will reach the product to be heated directly with a shorter wavelength.

Due to the injector action of the high-speed burners 6 which are fed with pressurized gas and combustion air, an underpressure is created under the thrust plate 10 at the inlet of the combustion chamber 11, as a result of which a part of the flue gas is recirculated through the space 18 behind each guiding plate 12 by way of the branch passages 17 and is burnt along with the mixture burning in the combustion chamber. As a result of this flue gas recirculation, the flame temperature is lowered and the $NO_x$ emission is reduced.

The non-recirculated part of the flue gases flows through the discharge gaps 14 at the end of the flow passages 15, via ducts 19 through the heat exchangers 20 where heat is given off to incoming combustion air before the flue gases are discharged via the ducts 21.

The air entering through the cavity c cools the wall 2 of the housing 1 and is preheated in the heat exchanger on its way to the burner head 7.

A good heat transfer of the heat of the flue gases to the radiation plate can be promoted by designing the radiation plate with guiding fins or ridges 26.

The gas-fired infrared radiator of closed design can be designed with a length of 100 cm, a width of 25 cm and a height of 10 cm. The dimensions of the radiation plate 5 are 100×25 cm. The radiation capacity is 25 kW.

I claim:

1. A gas-fired infrared radiator comprising a closed housing which includes a combustion chamber, with a side of the radiator that is to be directed towards an object being a radiation plate which forms a boundary of the combustion chamber, and comprising at least one burner, characterized in that said burner is a high-speed burner adapted for combustion in two combustion stages, with the second combustion stage taking place in the combustion chamber, said high-speed burner is arranged in such a manner that a flame formed by said high-speed burner is directed at the radiation plate, and gas guiding means are provided for partly recirculating flue gas which has been passed along the radiation plate, to one of said two combustion stages.

2. A gas-fired IR radiator according to claim 1, characterized in that said high-speed burner is arranged in such a manner that a flame formed by said high-speed burner is directed perpendicularly to the radiation plate.

3. A gas-fired IR radiator according to claim 2, characterized in that:

within the housing (1) downstream of the combustion chamber (11) at least one heat exchanger (22) is arranged, whose separate passages communicate, respectively, with a flue gas outlet (14) at the combustion chamber and with a combustion air inlet (23) at the back of the housing (1);

the housing is elongate and box-shaped, and includes provisions (8), distributed over the length of the housing (1), for the supply of gas and further passages (23, c, 22, 24, 25, 9) via which combustion air can be supplied, with baffles or guiding plates (12) being provided within the combustion chamber for guiding glue gases along the inside of the radiation plate (5);

a row of burners (6) are arranged, directed perpendicularly to the middle of the radiation plate (5) in the longitudinal center plane (M—M) of the housing (1), and guiding plates (12) of substantially L-shaped cross-section are symmetrically arranged on opposite sides of the longitudinal center plane (M—M) of the burner housing (1), in such a manner that said guiding plates (12) defined a narrow combustion chamber (11) opposite the row of burners, said narrow combustion chamber (11) beginning at a distance (a) from the row of burners (6) and ending, adjacent the radiation plate (5), in flow passages (15) extending on opposite sides of and away from the longitudinal center plane (M—M) of the housing (1) an ending in discharge gaps (14) adjacent the longitudinal side edges (13) of the guiding plates;

the burners (6) terminate behind a common thrust plate (10), said thrust plate being positioned at an inlet to said combustion chamber;

the flow passages (15) extending parallel to the radiation plate (5) coverage in downstream direction (b→b');

the gas guiding means are designed as branches (17) for flue gas, formed in the discharge gaps (14) by means of baffles (16), said branches (17) communicating via spaces (18) behind the guiding plates (12) with the combustion chamber (11) at the level of the second combustion stage;

the radiation plate (5) is made of a material selected from the group consisting of heat-resistant metal, ceramic material and quartz glass;

the guiding plates (12) are made of a material selected from the group consisting of heat-resistant metal, ceramic material and quartz glass;

the radiation plate, on the burner side thereof, is provided with guiding fins or ridges (26); and is at least partly made of double design, a cavity (c) present between the double wall forming part of the provisions for the supply of the combustion air.

4. A gas-fired IR radiator according to claim 1 characterized in that within the housing (1) downstream of the combustion chamber (11) at least one heat exchanger (22) is arranged, whose separate passages communicate, respectively, with a flue gas outlet (14) at the combustion chamber and with a combustion air inlet (23) at the back of the housing (1).

5. A gas-fired IR radiator according to claim 1, characterized in that the housing is elongate and box-shaped, and includes provisions (8), distributed over the length of the housing (1), for the supply of gas and further passages (23, c, 22, 24, 25, 9) via which combustion air can be supplied, with baffles or guiding plates (12) being provided within the combustion chamber for guiding flue gases along the inside of the radiation plate (5).

6. A gas-fired IR radiator according to claim 5, characterized in that a row of burners (6) are arranged, directed perpendicularly to the middle of the radiation plate (5) in the longitudinal center plane (M—M) of the housing (1), and guiding plates (12) of substantially L-shaped cross-section are symmetrically arranged on opposite sides of the longitudinal center plane (M—M) of the burner housing (1), in such a manner that said guiding plates (12) define a narrow combustion chamber (11) opposite the row of burners, said narrow combustion chamber (11) beginning at a distance (a) from the row of burners (6) and ending, adjacent the radiation plate (5), in flow passages (15) extending on opposite sides of and away from the longitudinal center plane (M—M) of the housing (1) and ending in discharge gaps (14) adjacent the longitudinal side edges (13) of the guiding plates.

7. A gas-fired IR radiator according to at least claim 5, characterized in that the housing (1) is at least partly made of double design, a cavity (c) present between the double wall forming part of the provisions for the supply of the combustion air.

8. A gas-fired IR radiator according to at least claim 6, characterized in that the flow passages (15) extending parallel to the radiation plate (5) converge in downstream direction (b→b').

9. A gas-fired IR radiator according to claim 7, characterized in that the radiation plate, on the burner side thereof, is provided with guiding fins or ridges (26).

10. A gas-fired IR radiator according to claim 6, characterized in that the gas guiding means are designed as branches (17) for flue gas, formed in the discharge gaps (14) by means of baffles (16), said branches (17) communicating via spaces (18) behind the guiding plates (12) with the combustion chamber (11) at the level of the second combustion stage.

11. A gas-fired IR radiator according to claim 6, characterized in that the guiding plates (12) are made of a material selected from the group consisting of heat-resistant metal, ceramic material and quartz glass.

12. A gas-fired IR radiator according to claim 1, characterized in that the burners (6) terminate behind a common thrust plate (10), said thrust plate being positioned at an inlet to said combustion chamber.

13. A gas-fired IR radiator according to claim 1, characterized in that the radiation plate (5) is made of a material selected from the group consisting of heat-resistant metal, ceramic material and quartz glass.

* * * * *